US007147546B1

(12) United States Patent
Dovel

(10) Patent No.: US 7,147,546 B1
(45) Date of Patent: Dec. 12, 2006

(54) TOOL HOLDER WITH MOVEABLE ALIGNMENT FINGER

(75) Inventor: Daniel T. Dovel, Shady Cove, OR (US)

(73) Assignee: Professional Tool Manufacturing, LLC, Ashland, OR (US)

( * ) Notice: Subject to any disclaimer, the term of this patent is extended or adjusted under 35 U.S.C. 154(b) by 67 days.

(21) Appl. No.: 11/244,479

(22) Filed: Oct. 6, 2005

(51) Int. Cl.
*B24B 1/00* (2006.01)

(52) U.S. Cl. ..... 451/48; 451/231; 451/375

(58) Field of Classification Search ..... 451/48, 451/231, 241, 375, 451, 457, 178; 269/60, 269/64, 358
See application file for complete search history.

(56) References Cited

U.S. PATENT DOCUMENTS

| | | | | |
|---|---|---|---|---|
| 4,001,975 | A | 1/1977 | Bernard et al. | |
| 4,031,672 | A | 6/1977 | Moores, Jr. et al. | |
| 4,088,333 | A * | 5/1978 | Nobile et al. | 279/60 |
| 4,093,247 | A * | 6/1978 | Bernard et al. | 279/53 |
| 4,176,499 | A | 12/1979 | Mazoff | |
| 4,455,786 | A | 6/1984 | Maysilles | |
| 4,485,596 | A | 12/1984 | Bernard et al. | |
| 4,520,599 | A | 6/1985 | Slinsky | |
| 4,642,942 | A | 2/1987 | Guhring | |
| 4,646,474 | A | 3/1987 | Chen | |
| 4,658,549 | A | 4/1987 | Lockwood | |
| 4,916,867 | A | 4/1990 | Lockwood | |
| 4,974,372 | A | 12/1990 | Chantalat | |
| 5,400,546 | A | 3/1995 | Christian et al. | |
| 5,649,853 | A * | 7/1997 | Kuo | 451/178 |
| 5,788,559 | A | 8/1998 | Jungnitsch | |
| 6,110,018 | A | 8/2000 | Hepworth | |
| 6,244,938 | B1 | 6/2001 | Ploeger | |
| 6,283,830 | B1 * | 9/2001 | Kuo | 451/11 |
| 6,652,367 | B1 | 11/2003 | Lin | |
| 6,676,494 | B1 | 1/2004 | Ching | |

FOREIGN PATENT DOCUMENTS

| | | |
|---|---|---|
| WO | 2004/028742 | 4/2004 |

* cited by examiner

*Primary Examiner*—Dung Van Nguyen
(74) *Attorney, Agent, or Firm*—Fellers, Snider, et al.

(57) ABSTRACT

Method and apparatus for facilitating sharpening of a tool. A tool holder is provided to present the tool for sharpening against an abrasive member, such as a grinding wheel. A moveable jaw member preferably engages a side of the tool to align the tool with a reference axis. The jaw member preferably supports an alignment finger which moves with the jaw member and which contactingly engages the tool to establish a desired angular orientation of the tool with respect to said axis. The tool preferably includes a flute surface and a cutting edge, and the alignment finger contacts the flute surface adjacent said cutting edge. The alignment finger is further preferably configured so that a distal end thereof is initially adjusted against the abrasive member, such as by a grinding operation, while the alignment member contactingly supports the tool.

24 Claims, 5 Drawing Sheets

TOOL HOLDER WITH MOVEABLE ALIGNMENT FINGER

FIELD OF THE INVENTION

The claimed invention relates generally to the field of tool sharpening systems and more particularly, but not by way of limitation, to an apparatus and method for using a moveable alignment finger to present a tool for sharpening.

BACKGROUND

Tools are routinely used to cut various types of materials, such as metal and wood. After extensive use, the cutting surfaces of such tools can become dull over time, and a tool with a dull cutting surface will generally not cut with the same precision or speed as a sharpened tool.

Hence, tool sharpeners are often employed to sharpen the cutting surfaces of tools, thereby extending the useful lives of such tools. It has often been found to be more economical to resharpen a dull tool as opposed to discarding the tool altogether and procuring a new replacement.

Depending on the configuration of the tool, a tool sharpening process can be relatively complex and not easily implemented manually. For example, U.S. Pat. No. 5,735,732, issued to Bernard and assigned to the assignee of the present application, generally discloses a drill bit sharpener that utilizes a chuck to hold a drill bit for sharpening. The chuck and bit are inserted into an alignment port to set various geometries of the bit with respect to the chuck, such as depth and angular orientation (timing angle).

Once aligned, the chuck and bit are inserted into a sharpening port wherein the bit is presented to a rotating grinding wheel to sharpen the cutting surfaces of the bit. As the chuck is rotated by the user, camming surfaces on the chuck control the depth and angle of the bit during the sharpening process. As desired, the chuck and bit can further be inserted into a split-point port in order to provide a split-point on the bit by removing material between the respective cutting surfaces on the drill bit tip.

While operable, there remains a continual need for improvements in the manner of sharpening various types of tools, such as drill bits, and it is to such improvements that the claimed invention is generally directed.

SUMMARY OF THE INVENTION

Preferred embodiments of the present invention are generally directed to an apparatus and method for facilitating the sharpening of a tool.

In accordance with preferred embodiments, a tool holder is provided to present the tool for sharpening against an abrasive member, such as a grinding wheel. A moveable jaw member preferably engages a side of the tool to align the tool with a reference axis. The jaw member preferably supports an alignment finger which moves with the jaw member and which contactingly engages the tool to establish a desired orientation of the tool with respect to said axis.

The tool preferably comprises a flute surface and a cutting edge, and the alignment finger contacts the flute surface adjacent said cutting edge. The alignment finger is further preferably configured so that a distal end thereof is adjusted against the abrasive member, such as by a grinding operation, and preferably while the alignment member contactingly supports the tool.

These and various other features and advantages which characterize the claimed invention will become apparent upon reading the following detailed description and upon reviewing the associated drawings.

DETAILED DESCRIPTION

Figure 1:
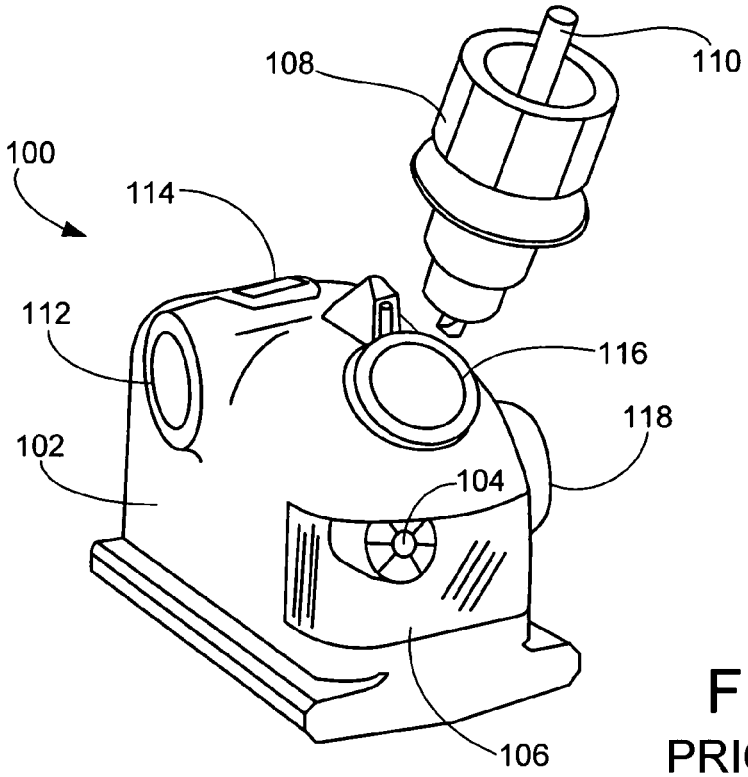
FIG. 1 PRIOR ART
FIG. 1 is a perspective representation of a tool sharpener of the prior art.

FIG. 1 shows a simplified representation of a tool sharpener 100 constructed in accordance with the prior art. FIG. 1 has been provided in order to set forth useful background information, as well as to generally illustrate an exemplary environment in which preferred embodiments of the present invention can be advantageously practiced. Additional information with regard to the tool sharpener 100 of FIG. 1 can be found in the aforementioned Bernard U.S. Pat. No. 5,735,732 reference.

The tool sharpener 100 comprises a rigid housing 102 that encloses various components of interest, including a motor and an abrasive member 104. The abrasive member is characterized as a high speed grinding wheel, and is visible in FIG. 1 through a transparent window 106 in the housing 102.

Figure 2:
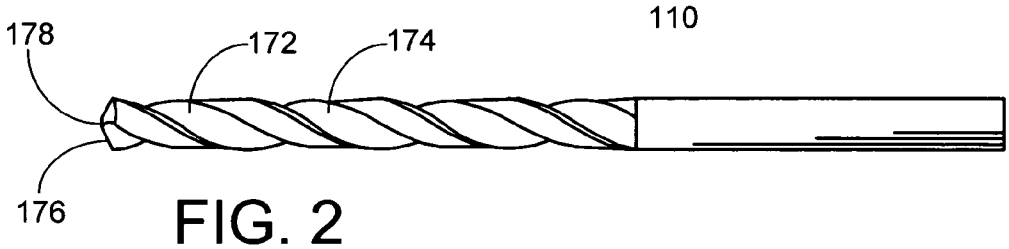
FIG. 2 PRIOR ART
FIG. 2 shows a drill bit as an exemplary type of tool particularly suited for sharpening by the sharpener of FIG. 1, as well as by preferred embodiments of the present invention.

A chuck assembly 108 is adapted to secure a tool 110 during the sharpening process. The tool preferably comprises a conventional twist drill bit as shown in FIG. 2, although other types of tools can also be sharpened by the sharpener 100.

The chuck assembly 108 utilizes an internal collet arrangement to clamp the periphery of the tool 110. The collet arrangement is adjustable to accommodate different diameters of tools.

After the tool 110 is initially secured by the chuck assembly 108, the chuck assembly 108 and the tool 110 are inserted into an alignment port 112 of the housing 102. Generally, the alignment port operates to establish the appropriate angular orientation of the tool 110 (i.e., rotational or timing angle) with respect to the chuck assembly 108.

A pair of opposing pawl members within the port 112 are advanced to engage opposing sides of the cutting (proximal) end of the tool 110. As observed by the user via view port 114, the tool 110 is rotated by the user through manipulation of the distal end of the tool 110 until the pawl members reach a minimum separation distance against the opposing sides of the cutting end. The appropriate insertion depth of the tool 110 with respect to the chuck 108 is also preferably set during this operation. The collet arrangement is tightened to retain the tool 110 in this final orientation.

Next, the chuck assembly 108 and the tool 110 are removed from the alignment port 112 and inserted into a sharpening port 116 for presentation of the cutting end against the abrasive member 104. The user rotates the chuck assembly 108 to follow inbound and swing camming surfaces (not shown in particular detail in FIG. 1) to cause the tool 110 to follow an eccentric path during the sharpening operation. After a suitable number of rotations (e.g., six), the tool will typically be sufficiently sharpened, and the chuck assembly 108 and the tool 110 can be removed from the sharpening port 116.

As desired, the chuck assembly 108 and the tool 110 can be inserted into a split-point port 118. This again presents the cutting edge of the tool 110 to the abrasive member 104, albeit at a different orientation as compared to the sharpening port 116. The operation of the split-point port 118 serves to remove material from the tip of the tool (i.e., between the respective cutting surfaces) to provide a split-point.

Figure 3:
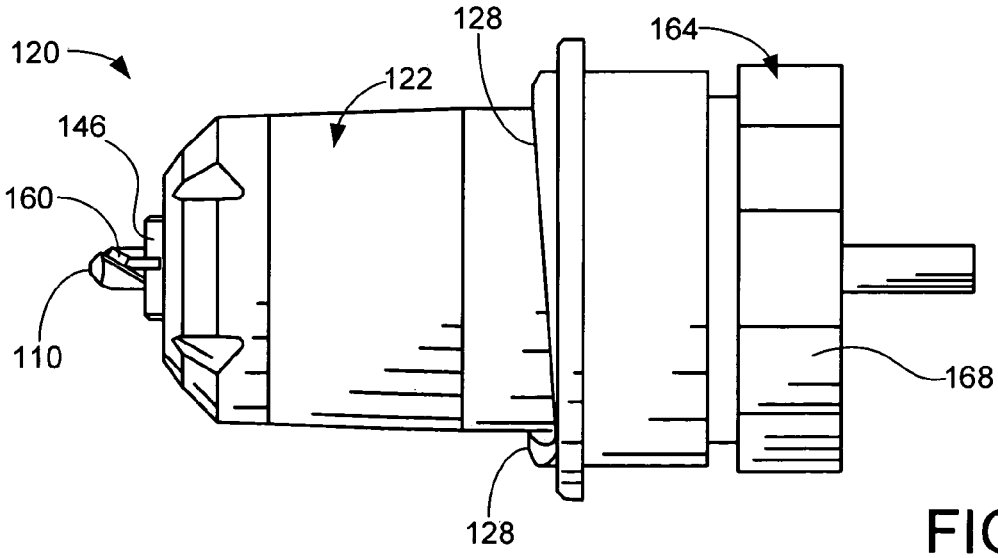
FIG. 3 is a side view of a chuck assembly constructed and operated in accordance with preferred embodiments of the present invention to align a tool such as the drill bit of FIG. 2 for sharpening against an abrasive member such as shown in FIG. 1.

FIG. 3 illustrates a chuck assembly 120 constructed and operated in accordance with preferred embodiments of the present invention. As will be discussed below in greater detail, the chuck assembly 120 advantageously permits presentation of the tool 110 for sharpening such as by, but not limited to, the use of the above described sharpening and point-splitting ports 116 and 118 of FIG. 1. However, the angular alignment and depth adjustments of the tool 110 are carried out by the chuck assembly 120 itself, advantageously eliminating the need for the alignment port 112 of FIG. 1.

Figure 4:
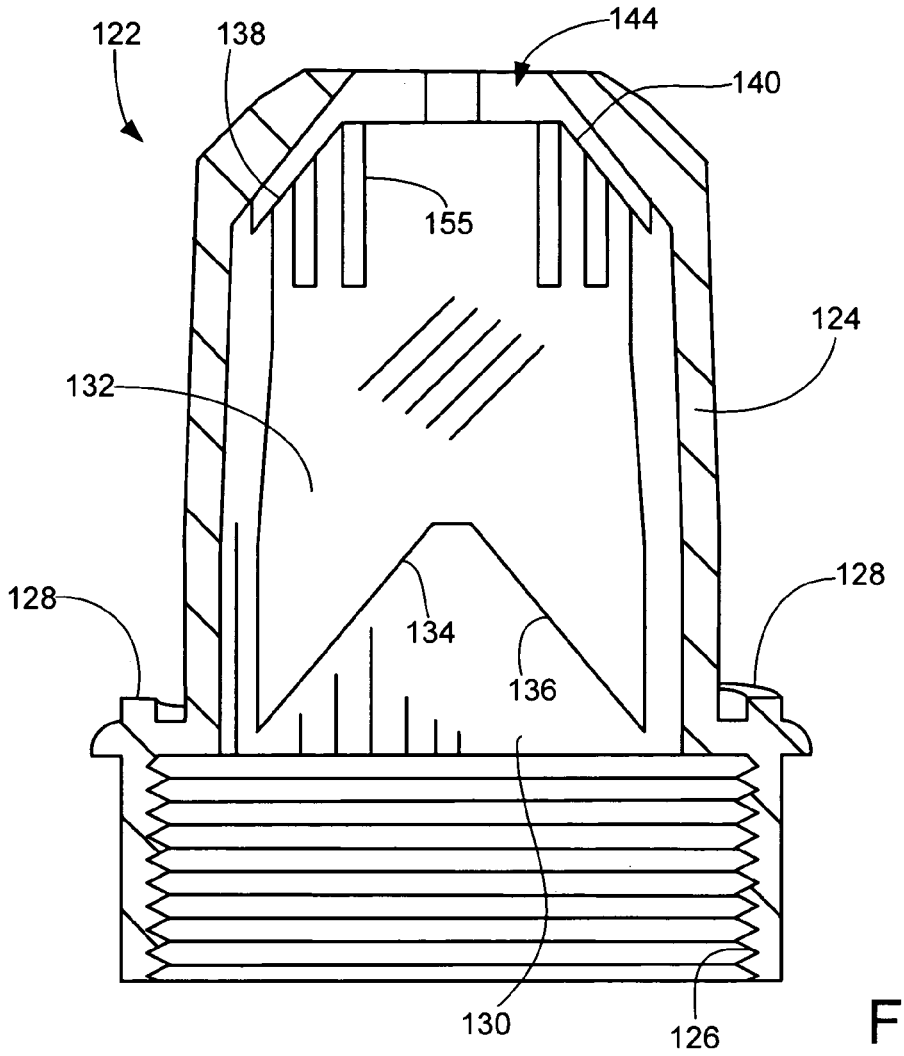
FIG. 4 provides a cross-sectional view of a housing member of the chuck assembly.

The chuck assembly 120, also referred to herein as a tool holder, includes a first housing member 122. A preferred construction for the housing member 122 is set forth in FIG. 4, which shows a circumferentially extending side wall 124 that defines a central orifice through the member 122. A first opening 126 in the housing member 122 includes a series of internal threads. External camming surfaces 128 (best viewed in FIG. 3) extend from the side wall 124 to serve as limit stops and thereby guide the chuck assembly 120 during the sharpening operation, as described above.

The side wall 124 is preferably provided with a substantially annular interior surface 130. This annular surface 130 supports a guide plate 132. The plate 132 is preferably flat so as to extend across the surface 130 in a chord-like fashion. Although not shown in FIG. 4, the housing member 122 preferably includes two such plates 132 on opposing sides of a central reference axis of the member 122.

The plate 132 includes lower guide surfaces (edges) 134, 136 which are angled upwardly and inwardly as shown. The interior surface 130 similarly includes a pair of upper guide surfaces 138, 140 which are preferably parallel to the guide surfaces 134, 136. A second opening 144 of the housing member 122 opposite the first opening 126 is preferably rectangular in cross-sectional shape.

Figure 5:
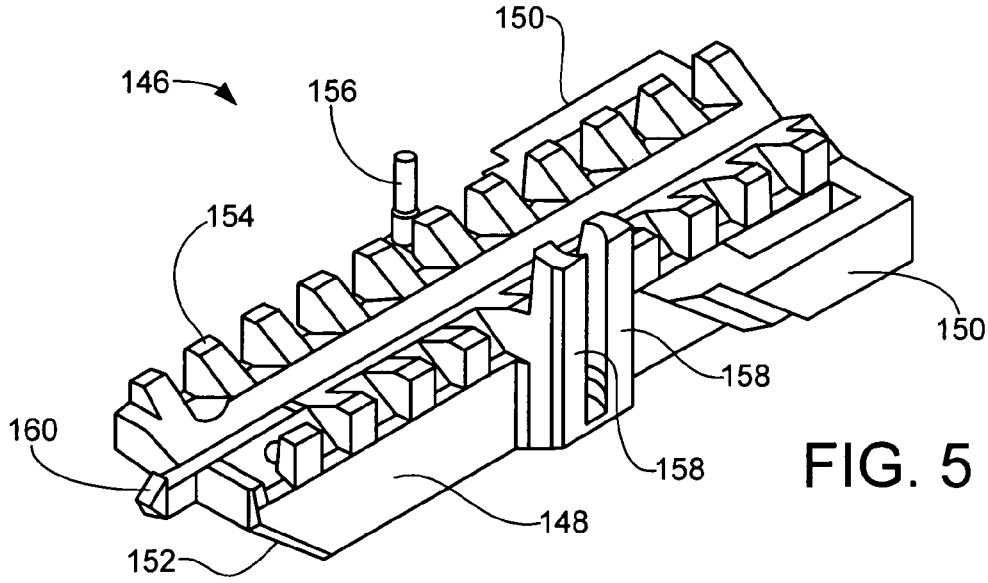
FIG. 5 provides an isometric view of a moveable jaw that cooperates with the housing member of FIG. 4 to advance the alignment finger and to engage a side of the drill bit.

A pair of opposing jaw members 146 are preferably disposed within the first housing member 122, one of which is shown in FIG. 5. The jaw member 146 includes a base 148 with opposing guide flanges 150 and tapered front surface 152. The flanges and front surface 152 cooperate with the respective guide surfaces 134, 136, 138 and 140 of FIG. 4 to advance the jaw member 146 inwardly and upwardly during operation. Ribs 155 (FIG. 4) preferably provide support to the respective sides of the jaw members 146 and help guide the jaw members 146 into the opening 144.

Two rows of opposing clamping fingers (one numerically denoted at 154) preferably project as shown from the base 148. The fingers 154 and base 148 form a generally v-shaped block. This allows the jaw member to contactingly engage a side of the tool 110 to align the tool 110 with a reference axis of the chuck assembly 120, and to accommodate different diameters of tools.

A cylindrical post 156 preferably extends from the base 148 to secure a first coiled spring (not shown in FIG. 5). A pair of spring retention arms 158 opposite the post 156 form a spring retention channel to accommodate a second coiled spring.

Figure 6:
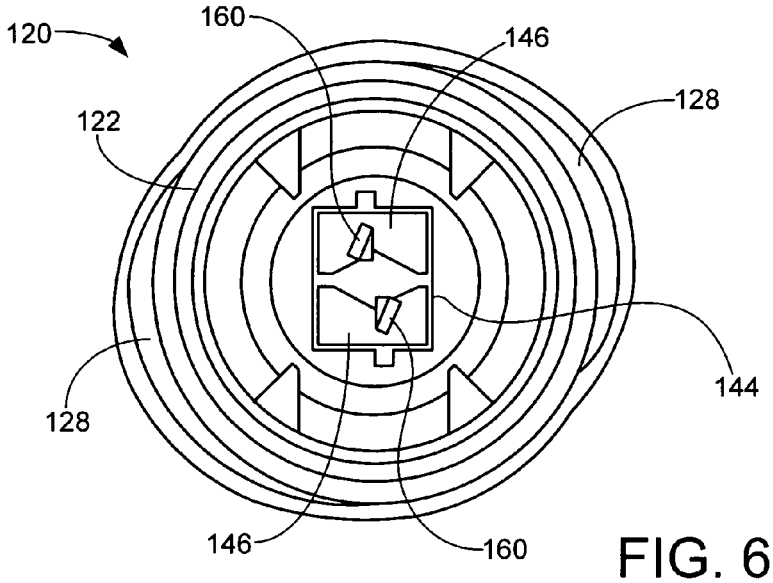
FIG. 6 is a top view of the chuck assembly of FIG. 3.

The base 148 further supports a rigid alignment finger 160, which projects from the base 148 to engage the cutting end of the tool 110. Additional views of the alignment fingers 160 of the respective jaw members 146 are provided in FIGS. 6 and 7.

Figure 7:
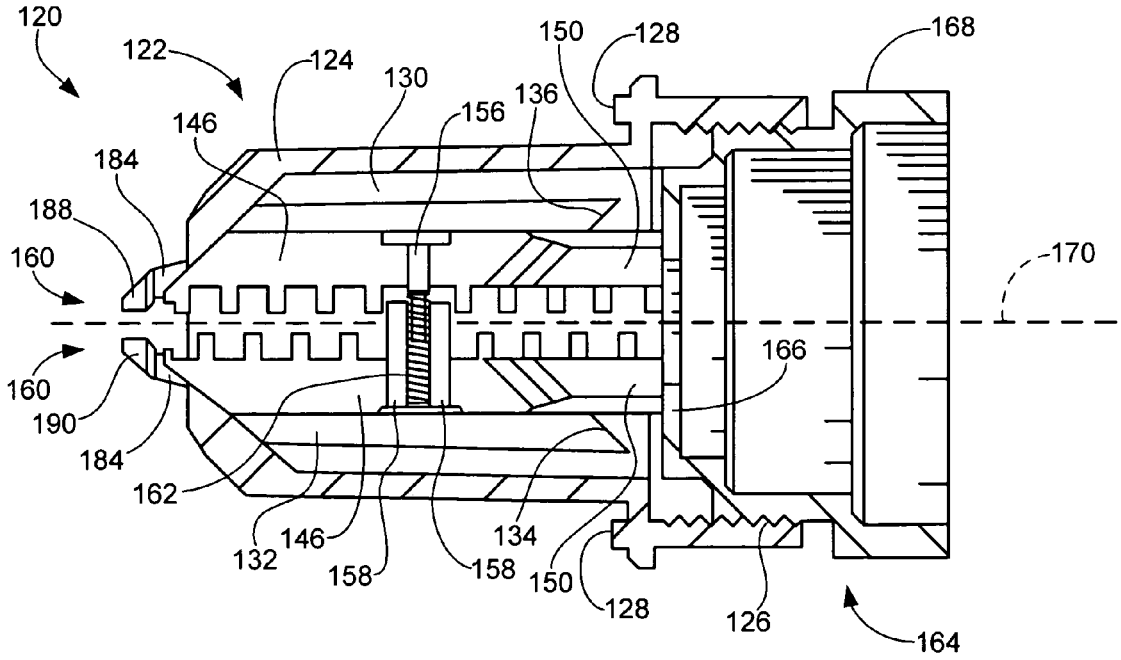
FIG. 7 provides a partial cross-sectional representation of a preferred construction for the chuck assembly of FIG. 3.

FIG. 7 shows one of the aforementioned first and second springs at 162 (the remaining spring is behind the first one and thus, has been omitted to simplify the view). These springs 162 provide a bias force so that the jaw members 146 are nominally biased away from each other.

FIG. 7 further shows a second housing member 164 which is inserted into the first end 126 of the first housing member 122. The second housing member 164 includes an external set of threads to engage the threads of the first housing member 122. The housing member 164 further includes an interior base surface 166 which abuts the jaw members 146. An annular, external grip surface 168 of the housing member 164 is also provided (see FIG. 3).

User rotation of the second housing member 164 by way of the grip surface 168 causes threaded advancement of the second housing member 164 with respect to the first housing member 122. This advances the base surface 166 which, in turn, urges the jaw members 146 to slidingly advance upwardly and inwardly by tracked movement along the respective guide surfaces 134, 136, 138 and 140. This movement of the jaw members 146 is in opposition to the biasing force supplied by the springs 162.

In this way, the jaw members 146 controllably move toward and away from each other in response to rotation of the grip surface 168 in clockwise and counter-clockwise directions, respectively. During such movement, the jaw members 146 are preferably maintained in a substantially parallel orientation with respect to the reference axis (denoted by broken line 170). The alignment fingers 160 move in linear fashion with the jaw members 146 toward and away from the reference axis 170 at an angle defined by the surfaces 138, 140. A preferred range for this angle is from about 30 to about 60 degrees with respect to the axis 170.

As shown in FIGS. 8–11, the fingers 160 preferably engage opposing recessed flute surfaces 172, 174 that helix, or spiral, along the length of the bit (see FIG. 2). The material between the respective flute surfaces 172, 174 is referred to as the web, and the minimum distance between these surfaces 172, 174 is referred to as the web thickness.

A particularly useful feature of this type of tool configuration is the ability to achieve a substantially straight cutting edge by cutting the tool at a selected angle. As shown in FIG.

8, opposing, substantially straight cutting edges 176 extend downwardly from a chisel edge 178 at the tip of the tool 110.

The intermediary angle between the cutting edges 176 can vary, but may be on the order of from about 110 degrees to 135 degrees or more, with 118 degrees being a commonly employed value. The angle θ between each cutting edge 176 and the chisel edge 178 can also vary, with a commonly employed value being about 120 degrees or so.

Adjacent each cutting edge 176 is a relief surface 180, which curves away and downwardly from the cutting edge 176 at a small, selected relief angle r (best viewed in FIG. 11) to a curvilinear trailing edge 182. It is generally desirable to take into account these and other factors when sharpening the tool in order to achieve the desired final cutting characteristics for the sharpened tool.

Figure 10:
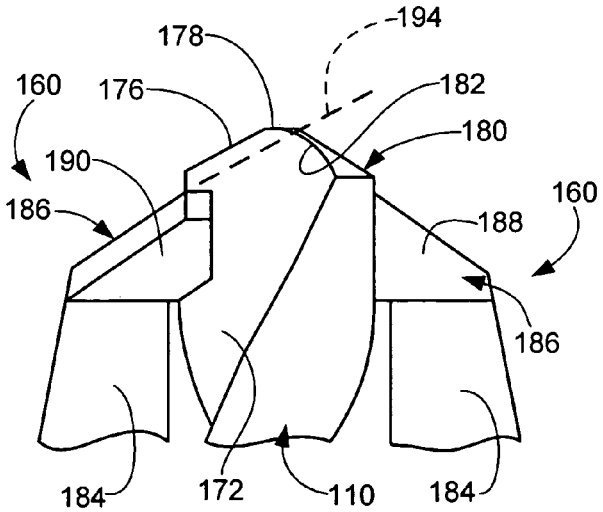
FIGS. 10 and 11 provide additional views of the alignment fingers in conjunction with a drill bit.

As best viewed in FIG. 10, each finger 160 preferably includes a base portion 184 which is substantially aligned with the reference axis 170 (FIG. 7), and a support portion 186 which cants at an angle with respect to the base portion 184. The support portion 186 includes an inner support surface 188 and an outer surface 190.

The inner support surface 188 contactingly abuts the respective flute surface 172, 174 at a position just below the cutting edge 176. For reference, this portion of the respective flute surface below the cutting edge 176 is referred to herein as a leading surface, and that portion of the flute surface below the trailing edge 182 is referred to as the trailing surface. While two opposing fingers 160 as shown, this is for purposes of illustrating a preferred embodiment and is not limiting; in an alternative embodiment, a single finger 160 is used to establish the angular orientation of the tool through contact with a single leading surface of the tool.

Figure 8:
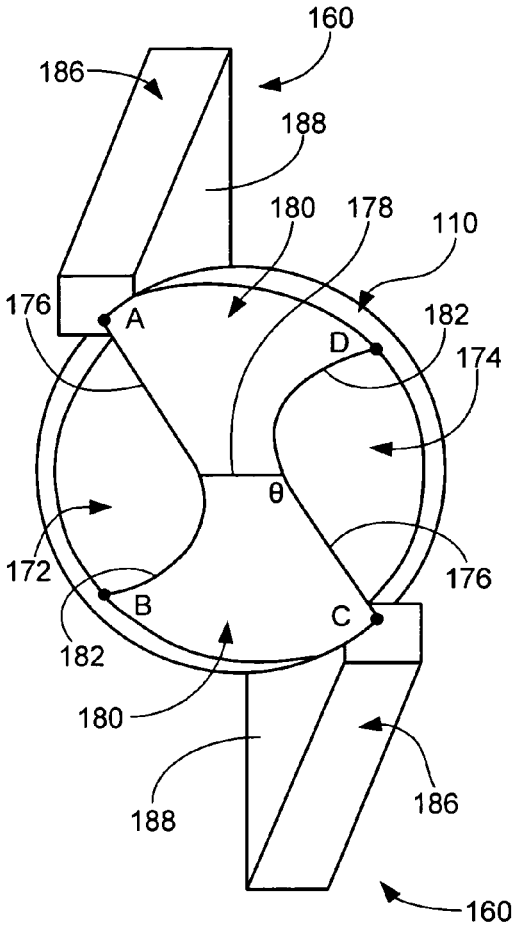
FIG. 8 illustrates the alignment fingers of the chuck assembly in conjunction with a first drill bit with a relatively large web thickness.
Figure 9:
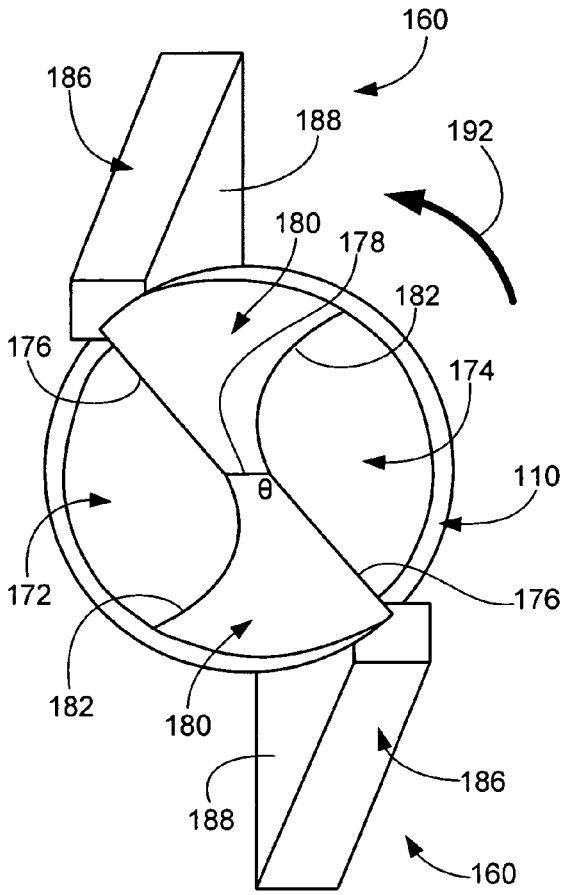
FIG. 9 illustrates the alignment fingers of the chuck assembly in conjunction with a second drill bit with a relatively small web thickness.

It can be seen from a comparison of FIGS. 8 and 9 that the fingers 160 advantageously accommodate tools with significant variations in web thickness. As those skilled in the art will recognize, web thickness is not necessarily directly related to overall diameter; some larger diameter bits can have relatively smaller web thicknesses, and some smaller diameter bits can have relatively larger web thicknesses.

In FIGS. 8 and 9, both of the bits have the same nominal diameter, but the bit in FIG. 9 has a smaller web thickness than that of FIG. 8. Accordingly, the angular orientation of the bit in FIG. 9 is advanced slightly (as indicated by arrow 192) as compared to the bit in FIG. 8. Since the fingers 160 are in the same respective locations in both FIGS. 8 and 9, it is the individual geometries of each bit that establishes the relative angular orientation for each bit. In this way, each bit presented to the abrasive member 104 will nominally have an optimum angular orientation suitable for the particular construction of that bit.

It will be recalled from FIG. 1 that a pair of pawls are described as being used in the prior art sharpener 100 to contactingly engage opposing sides of the tool 100. These pawls are characterized as deflectable leaf springs which engage a total of four (4) points on the tool 100 identified at points A, B, C and D in FIG. 8. More particularly, the first pawl spans the flute 172 to contact the leading and trailing edges at points A and B, and the second pawl spans the flute 174 to contact the leading and trailing edges at points C and D.

While operable, a limitation with this approach is the reliance on the locations of the trailing edges (e.g., points B and D) in order to set the appropriate timing angle for the bit. As those skilled in the art will recognize, drill bit configurations can vary significantly from vendor to vendor, as well as over time. For example, it is becoming increasingly common for new generations of drill bits to have significantly altered curvatures and trailing edge placements as compared to those shown in FIGS. 8 and 9. These and other factors make it increasingly difficult to establish the correct angular alignment of the tool prior to sharpening.

By contrast, the moveable, rigid alignment fingers embodied herein eliminate the errors that can be introduced through use of both the leading and trailing edges (e.g., A-B, C-D) to set the timing angle for the tool.

By definition, a sharpening process will result in the removal of at least some material from the tool 110. When a dull bit is presented for sharpening, the target surfaces and edges to be exposed by the sharpening process (e.g., cutting edges 176, chisel 178, relief surfaces 180, etc.) are initially contained within the existing material of the dull bit, and excess material from the bit will preferably be removed to expose these surfaces and edges. These target surfaces and edges can be thought of as lying along an imaginary curved plane that initially extends through the bit.

The fingers 160 advantageously operate to locate this plane, and to control the removal of material down thereto. As shown in the embodiment of FIG. 10, material will be removed down to the fingers 160, as indicated by broken line 194. It follows that, while the cutting edges 176 are shown in the overhead views of FIGS. 8 and 9 to extend over the fingers 160, at the conclusion of the sharpening process and removal of the material above line 194, the resulting cutting edges will be substantially aligned with the support surfaces 188 of the fingers 160.

Preferably, the fingers 160 are further configured so as to initially extend beyond this imaginary plane to which the tool 110 is to be ground. It will be recalled that the chuck assembly 120 is preferably configured for insertion into a sharpening port such as 116 in FIG. 1 in order to present the tool 110 against the abrasive member 104 in a controlled fashion. In such case, the extent to which the tips of the fingers 160 initially "interfere" with (or "reach") the abrasive member will be a function of the relative geometries of the chuck assembly 120, the associated port, the distance and angle of the abrasive member 104, etc.

Figure 11:
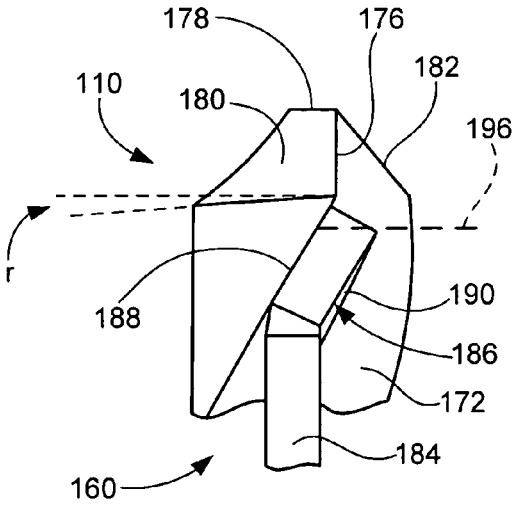

It can be seen that if such overlap occurs, during an initial grinding operation a portion of the distal end of the finger 160 will also be removed by the abrasive member, such as indicated by broken line 196 in FIG. 11. That is, that portion of the finger 160 above the line 196 will also be removed during the sharpening of the tool 110.

An advantage of this embodiment is that after this initial grinding operation, the fingers 160 will nominally be set to the specific manufacturing tolerances and variations of the particular system in which the fingers 160 are employed. That is, after the first sharpening operation, each subsequent sharpening operation will generally result in the removal of material from the tool down to the "exposed" surfaces of the fingers 160 (with little or no additional removal of material from the fingers). In this way, the exposed surfaces of the fingers 160 will lie along a portion of the aforementioned imaginary plane, so that the precise point at which material will be ground down to can be accurately observed as each tool 110 in turn is installed into the chuck assembly 120.

While preferred, it not necessarily required that the alignment fingers 160 extend all the way to this imaginary plane; rather, in an alternative embodiment the fingers are recessed from this plane so that, at the conclusion of the sharpening process, a short vertical distance will exist between the cutting surface 176 and the top of the respective finger 160. Based on the foregoing discussion, however, those skilled in the art will recognize that as the fingers 160 are brought closer to the final cutting surfaces 176, the resulting sharpening geometries will generally be more precise.

Irrespective of whether the distal ends of the fingers 160 are configured to be ground off, in each case the fingers are preferably arranged so as to minimize the length of the chisel 178 at the completion of the grinding operation. One reason is because the primary cutting of the workpiece is generally carried out by the cutting surfaces 176; during operation the chisel 178 will more or less simply rotate against the workpiece and generate heat. Adding a split point to the chisel will generally help, since this removes material from the bit so as to provide two small, opposing cutting surfaces along the chisel edge. Nevertheless, improved cutting efficiency is generally gained by reducing the chisel length to as small a distance as practical.

At the same time, chisel length is influenced by chisel angle and relief angle. Relief angle r was referenced previously in FIG. 11. Chisel angle is the angle θ between the chisel 178 and the cutting surfaces 176 (see FIGS. 8 and 9). Preferably, the fingers 160 orient the tool 110 so that the chisel length is minimized while maintaining the chisel angle within a preferred range (e.g., around 110 to 130 degrees) and maintaining positive relief (i.e., the relief surface 180 falls down below horizontal as shown in FIG. 11).

Accordingly, it can be seen from FIGS. 8 and 9 that as the web gets thinner, generally the chisel angle θ will increase, and the cutting surfaces 176 will rotationally advance per direction 192 (counter-clockwise). As the web gets thicker, the chisel angle will decrease, and the cutting surfaces 176 will be rotationally retracted in the direction opposite 192 (clockwise).

FIGS. 12–15 show an alternative preferred embodiment for the moveable alignment fingers 160. In this embodiment, the fingers 160 are each preferably characterized as extending in a direction substantially parallel to the reference axis 170. The fingers each preferably have a rectangular cross-sectional shape, although other shapes can be readily used as well. It is contemplated that the fingers 160 of FIGS. 12–15 are configured to be adjusted down to line 196 by contactingly engaging the abrasive member 104, such as by way of a grinding operation against the member. A point (line) contact is preferably provided between each finger 160 and the corresponding flute surfaces 172, 174.

Figure 12:
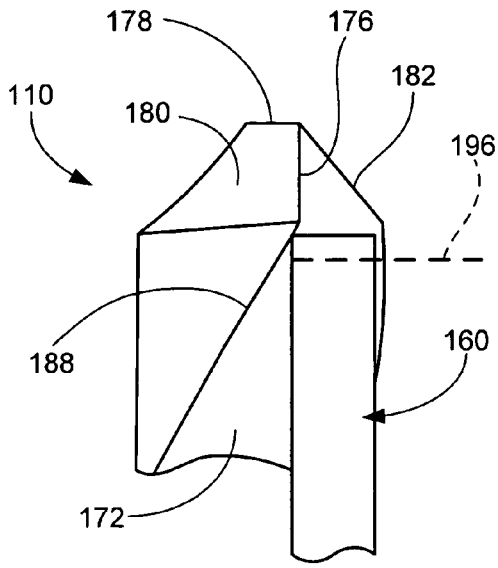
FIGS. 12–15 provide another alternative preferred configuration for the alignment finger and generally illustrate a preferred sharpening sequence involving the same.

Prior to the initial grinding of the distal ends of the fingers 160, a selected bit 110 can be inserted into the chuck assembly, as shown in FIG. 12. In this initial orientation, the respective flute surfaces 172, 174 will establish the aforementioned point contacts against the respective fingers 160. The bit 110 will remain in this orientation as a result of the clamping force provided to the sides of the bit 110 by the jaw members 146, as described above.

Figure 13:
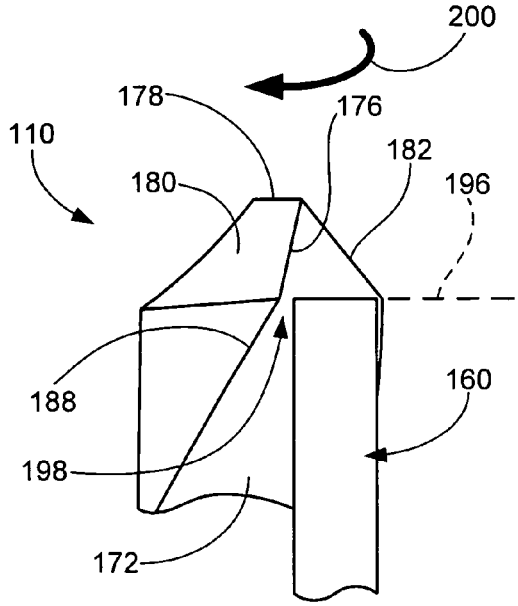

After presenting the chuck assembly 120 and the bit 110 against the abrasive member 104 to remove material down to line 196, a resulting gap 198 will typically exist between each flute 172, 174 and the associated finger 160, as shown in FIG. 13. These gaps 198 will occur as a result of the retraction of the cutting surfaces 176 away from the fingers 160 in rotational direction 200 (clockwise, or opposite that of direction 192 in FIG. 9), and the removal of material from the distal ends of the fingers 160.

Figure 14:
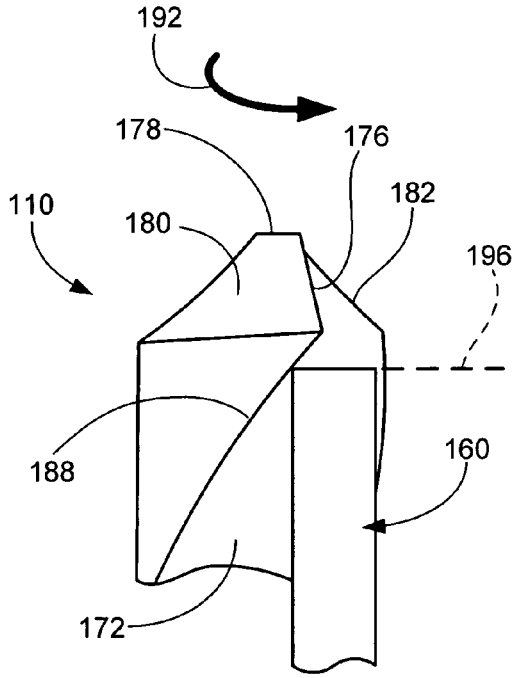
Figure 15:
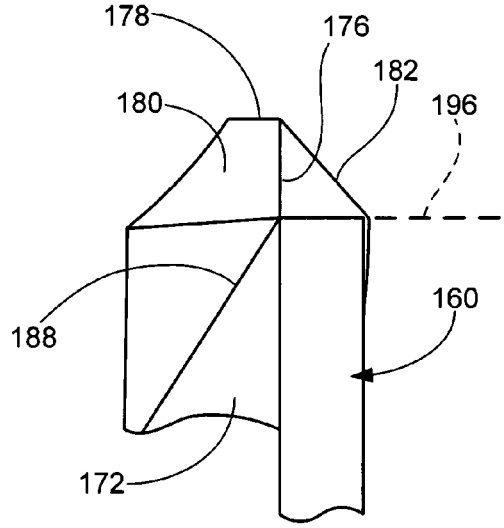

Thereafter, when a second selected tool 110 is placed into the chuck assembly 120 and the flutes 172, 174 come into point contact with the respective fingers 160, the cutting surfaces 176 will be advanced with respect to the fingers 160 (in direction 192) so as to overhang the fingers 160, as shown in FIG. 14. The subsequent application of the grinding operation will preferably retract the cutting surfaces 176 so as to be nominally aligned with the fingers 160 at the conclusion of the grinding operation, as shown in FIG. 15.

Although preferred, it is not required that the tool 110 actually be loaded into the chuck assembly 120 during the initial adjustment operation of FIGS. 12 and 13; even without actually supporting a tool, the fingers 160 will still be ground down to the line 196. Thus, whether or not a tool is actually loaded, in either case the fingers 160 are capable of supporting the tool during this initial grinding operation.

It will be noted that while grinding has been identified as the preferred adjustment technique to set the desired elevational length of the fingers 160, such is not necessarily limiting. Rather, any number of adjustment techniques can be alternatively used, including but not limited to permanently bending of the fingers 160 or sliding retraction of the fingers 160 into press-fit recesses (not shown) in the associated jaw members.

As mentioned previously, the chuck assembly 120 preferably utilizes camming surfaces (e.g., 128) which cooperate with the housing 102 to controllably vary the insertion depth of the chuck assembly 120, and hence the fingers 160. These camming surfaces allow the various curvilinear characteristics (e.g., relief surface 180, etc.) to be applied to the sharpened tool using a flat or curved surface of the abrasive member 104.

It will now be appreciated that the elevational height of the fingers 160 (e.g., line 196) with respect to the first housing member 122 (FIG. 4) will depend on the diameter of the tool 110; since the fingers 160 move with the jaw members 146, the fingers 160 will project substantially farther for smaller diameter tools and will be retracted somewhat for larger diameter tools. Thus, the line 196 is not a fixed distance from the housing member 122, but rather a line that will move upwardly and inwardly as the diameter of the tool is decreased.

Nevertheless, in each case the fingers 160 are preferably arranged so as to contactingly engage the flute surfaces 172, 174 at the appropriate elevation for the particular tool diameter, and will compensate for web thickness to provide substantially the shortest chisel 178 will maintaining chisel angle and relief angle at appropriate levels.

The embodiments as presented herein provide certain advantages over the prior art. First, the moveable finger(s) 160 of the chuck assembly 120 eliminate the need to install the tool and obtain separate alignment (such as angular orientation and depth) prior to the sharpening process. Rather, the tool 110 can merely be inserted into the chuck assembly 120 and rotated by hand until the support surfaces 188 of the fingers 160 abut the leading surfaces adjacent the cutting edges 176, after which the grip surface 168 can be rotated to tighten the tool 110 in place. As desired, the chuck assembly 120 is then ready for presentation of the tool against the abrasive member, such as (but not limited to) the use of the sharpening and split-point ports 116, 118 of FIG. 1.

The fingers 160 further allow precise determination of the amount of material to be removed from the tool, which is determined in relation to the distance from the existing cutting surfaces down to the fingers 160. The alignment is thus based on where the ultimate cutting surfaces will be, not where the existing (dull) cutting surfaces are presently on the tool.

Further configuring the fingers 160 to be initially adjusted against the abrasive member, such as by grinding, provides an additional benefit of precisely identifying the final location of the cutting surfaces 176 on the tool 110. This allows manufacturing tolerances and variations associated with the fingers, the chuck, the location and size of the abrasive member, etc. to be adaptively compensated.

While preferred embodiments presented herein place the moveable finger on a chuck assembly, such is not necessarily required; rather, any number of types of tool holders can be utilized as desired.

In view of the foregoing, it will now be understood that the preferred embodiments of the present invention are generally directed to an apparatus and method for facilitating the sharpening of a tool.

In accordance with some embodiments, the apparatus can be generally characterized as comprising a tool holder (such as 120) configured to present a tool (such as 110) for sharpening against an abrasive member (such as 104), the tool holder comprising a moveable jaw member (such as 146) which engages a side of the tool to align the tool with a reference axis (such as 170), the jaw member supporting an alignment finger (such as 160) which moves with the jaw member and which contactingly engages the tool to establish a desired orientation of the tool with respect to said axis.

In accordance with other embodiments, the apparatus can be characterized as a tool holder (such as 120) configured to present a tool (such as 110) for sharpening against an abrasive member (such as 104), the tool holder comprising a moveable alignment finger (such as 160) which establishes an orientation of the tool and which comprises a distal end configured to be adjusted against the abrasive member (such as at 194).

In accordance with other embodiments, the method can be characterized as comprising steps of providing a tool holder (such as 120) comprising a moveable jaw member (such as 146) that supports an alignment finger (such as 160) configured to establish a desired orientation of a tool (such as 110) inserted into said holder, and advancing the tool holder to present the tool against an abrasive member (such as 104) to sharpen the tool while the alignment finger maintains said desired orientation of the tool.

For purposes herein, the terms "sharpen," "sharpening" and the like will be understood consistent with the foregoing discussion to mean the removal of material from a tool irrespective of the resulting "sharpness" or other characteristics of said tool at the end of such process. In this way, the terms will not imply a particular or minimum degree of "sharpness" in order for the claim limitations to be met.

Similarly, reference to the alignment finger as having a distal end configured to be ground off by the abrasive member while a tool is sharpened against the abrasive member will be understood, consistent with the foregoing discussion, to not require that the alignment finger be ground off each time a tool is presented for sharpening. Rather, this language is met by the alignment finger being configured for such grounding during an initial sharpening process, whether performed prior to or after product shipment to the end user, and irrespective whether or not a tool is actually in place during such grounding.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary depending on the particular environment without departing from the spirit and scope of the present invention.

In addition, although the embodiments described herein are generally directed to a sharpening system for sharpening drill bits, it will be appreciated by those skilled in the art that the claimed subject matter is not so limited and various other sharpening systems and tools can be utilized without departing from the spirit and scope of the claimed invention.

What is claimed is:

1. An apparatus comprising a tool holder configured to present a tool for sharpening against an abrasive member, the tool holder comprising a moveable jaw member which engages a side of the tool to align the tool with a reference axis, the jaw member supporting an alignment finger which moves with the jaw member to contactingly engage the tool and establish a desired orientation of the tool with respect to said axis.

2. The apparatus of claim 1, wherein the tool comprises a flute surface and a cutting edge, and wherein the alignment finger contacts the flute surface adjacent said cutting edge.

3. The apparatus of claim 1, wherein the jaw member is characterized as a first jaw member and the alignment finger is characterized as a first alignment member, and wherein the apparatus further comprises a second jaw member which supports a second alignment finger which moves with the second jaw member and which contactingly engages the tool to further establish the desired orientation of the tool with respect to said axis.

4. The apparatus of claim 1, wherein the tool holder further comprises a housing member in which the jaw member is disposed and through which the tool and the alignment finger respectively extend, the housing member controlling an insertion depth of the alignment finger with respect to the abrasive member.

5. The apparatus of claim 4, wherein the housing member is characterized as a first housing member, and wherein the tool holder further comprises a second housing member which moves with respect to the first housing member to advance the jaw member and the alignment finger.

6. The apparatus of claim 4, wherein the housing member comprises at least one guide surface, and wherein the jaw member slides along the at least one guide surface to advance the jaw member and the alignment finger.

7. The apparatus of claim 1, wherein the alignment finger extends substantially parallel to the reference axis and forms a point contact against the tool.

8. The apparatus of claim 1, wherein the alignment finger comprises a rigid canted portion which extends non-parallel to the reference axis, the canted portion including opposing inner and outer surfaces, wherein the inner surface contactingly abuts a recessed surface of the tool.

9. The apparatus of claim 1, wherein the alignment finger further comprises a distal end configured to be adjusted against the abrasive member while the alignment member contactingly supports the tool.

10. The apparatus of claim 9, wherein said adjustment of the distal end of the alignment finger comprises a grinding operation with the abrasive member.

11. An apparatus comprising a tool holder configured to present a tool for sharpening against an abrasive member, the tool holder comprising a moveable alignment finger which establishes a desired orientation of the tool and which comprises a distal end configured to be adjusted against the abrasive member to establish an effective length of the alignment finger.

12. The apparatus of claim 11, further comprising a moveable jaw member which supports the alignment member, the jaw member configured to engage a side of the tool to align the tool with a reference axis.

13. The apparatus of claim 11, wherein the tool comprises a flute surface and a cutting edge, and wherein the alignment finger contacts the flute surface adjacent said cutting edge.

14. The apparatus of claim 11, wherein the distal end is adjusted against the abrasive member by way of a grinding operation upon said alignment finger.

15. An apparatus comprising a tool holder configured to engage a limit stop to present a tool for sharpening against an abrasive member, the tool holder comprising a moveable jaw member which engages a side of the tool to align the tool with respect to a reference axis, and first means supported by the jaw member for establishing a desired orientation of the tool with respect to said axis while the tool is engaged by said jaw.

16. The apparatus of claim 15, wherein the first means comprises a rigid alignment finger which moves with the jaw member and which contactingly engages the tool to establish said desired orientation of the tool.

17. The apparatus of claim 15, wherein the alignment finger comprises a distal end configured to be adjusted against the abrasive member to expose a surface that nominally aligns with a target surface to which the tool is to be ground.

18. The apparatus of claim 17, wherein said adjustment of the distal end of the alignment finger comprises a grinding operation with the abrasive member.

19. The apparatus of claim 15, wherein the tool comprises a flute surface and a cutting edge, and wherein the first means engages the flute surface adjacent said cutting edge.

20. The apparatus of claim 19, wherein the flute surface and the cutting edge are respectively characterized as a first flute surface and a first cutting edge, wherein the tool further comprises a second flute surface opposite the first flute surface, a second cutting edge opposite the first cutting edge, a web thickness as a distance between the first and second flute surfaces and a chisel edge which extends across the web thickness from the first cutting edge to the second cutting edge, and wherein the first means further operates to rotationally advance the resulting first and second cutting edges for tools with relatively shorter web thicknesses, and to rotationally retract the resulting first and second cutting edges for tools with relatively longer web thicknesses.

21. A method comprising steps of providing a tool holder comprising a moveable alignment finger configured to establish a desired orientation of a tool inserted into said holder, and adjusting the alignment finger against the abrasive member to establish an effective length of the alignment finger.

22. The method of claim 21, wherein the tool holder of the providing step further comprises a moveable jaw member which supports the alignment member, the jaw member configured to engage a side of the tool to align the tool with a reference axis.

23. The method of claim 21, wherein the adjusting step comprises a grinding operation with the abrasive member.

24. The method of claim 22, wherein the tool comprises a flute surface and a cutting edge, and wherein the alignment finger engages the flute surface adjacent said cutting edge.

* * * * *